US009358538B2

(12) United States Patent
Beroz et al.

(10) Patent No.: US 9,358,538 B2
(45) Date of Patent: Jun. 7, 2016

(54) HIGH RESOLUTION PIPETTE

(71) Applicant: The Regents of the University of Michigan, Ann Arbor, MI (US)

(72) Inventors: Justin Douglas Beroz, Ann Arbor, MI (US); Anastasios John Hart, Ann Arbor, MI (US)

(73) Assignee: The Regents of the University of Michigan, Ann Arbor, MI (US)

( * ) Notice: Subject to any disclaimer, the term of this patent is extended or adjusted under 35 U.S.C. 154(b) by 368 days.

(21) Appl. No.: 13/873,962

(22) Filed: Apr. 30, 2013

(65) Prior Publication Data

US 2013/0283884 A1 Oct. 31, 2013

Related U.S. Application Data

(60) Provisional application No. 61/640,264, filed on Apr. 30, 2012.

(51) Int. Cl.
*B01L 3/02* (2006.01)

(52) U.S. Cl.
CPC ..... *B01L 3/0293* (2013.01); *B01L 3/0217* (2013.01); *B01L 3/0275* (2013.01); *B01L 2200/023* (2013.01); *B01L 2200/141* (2013.01); *B01L 2200/146* (2013.01); *B01L 2200/148* (2013.01); *B01L 2400/0478* (2013.01); *B01L 2400/0481* (2013.01)

(58) Field of Classification Search
CPC ... B01L 3/0293; B01L 3/0217; B01L 3/0275; B01L 3/148; B01L 3/141; B01L 3/023; B01L 3/146; B01L 2400/0478; B01L 2400/0481
USPC ..... 73/1.74, 864.01, 864.11, 864.16
See application file for complete search history.

(56) References Cited

U.S. PATENT DOCUMENTS

| | | | |
|---|---|---|---|
| 4,999,164 | A | 3/1991 | Puchinger et al. |
| 5,012,682 | A | 5/1991 | Sabloewski |
| 5,343,909 | A | 9/1994 | Goodman |
| 5,511,433 | A | 4/1996 | Sabloewski et al. |
| 6,199,435 | B1 | 3/2001 | Wilmer et al. |
| 6,910,395 | B2 | 6/2005 | Bülow |
| 7,320,260 | B2 | 1/2008 | Belgardt |
| 7,421,913 | B2 | 9/2008 | Belgardt et al. |

(Continued)

FOREIGN PATENT DOCUMENTS

DE 102010045452 * 3/2012 ..... B01L 3/021

*Primary Examiner* — John Fitzgerald
*Assistant Examiner* — Suman K Nath
(74) *Attorney, Agent, or Firm* — Reising Ethington P.C.

(57) ABSTRACT

A pipette includes a movable piston and a diaphragm that at least partly defines a fluid chamber enclosing a volume of working fluid. The piston displaces a volumetric amount of the working fluid in the chamber when moved. In response, the diaphragm displaces a smaller volumetric amount of fluid outside the chamber. A deamplification ratio is defined by the ratio of the volume displaced by the diaphragm to the volume displaced by the piston. The deamplification ratio is adjustable by adjusting or changing the diaphragm and/or by adjusting the size of the fluid chamber. The deamplifying pipette enables measuring and dispensing of very small volumes of liquid and is easily adapted to commercially available pipette components. Pipette components such as a pipette tip or adaptor may include a diaphragm to enable deamplification of the nominal volume capacity of a given pipette device.

38 Claims, 11 Drawing Sheets

(56) References Cited

U.S. PATENT DOCUMENTS

| | | | | |
|---|---|---|---|---|
| 7,434,484 | B2 | 10/2008 | Belgardt | |
| 8,021,627 | B2 | 9/2011 | Molitor | |
| 2005/0119618 | A1* | 6/2005 | Gonnelli | A61M 5/1452 604/150 |
| 2006/0222570 | A1* | 10/2006 | Molitor | B01L 3/021 422/400 |
| 2010/0083775 | A1 | 4/2010 | Wilmer | |
| 2012/0048884 | A1* | 3/2012 | Wang | B01L 3/0293 222/1 |

* cited by examiner

HIGH RESOLUTION PIPETTE

This application claims the benefit of U.S. Provisional Patent Application No. 61/640,264 filed Apr. 30, 2012, the entire contents of which are hereby incorporated by reference.

STATEMENT REGARDING FEDERALLY-SPONSORED RESEARCH

This invention was made with government support under DE-SC0004927 awarded by the Department of Energy. The government has certain rights in the invention.

TECHNICAL FIELD

This disclosure relates to pipettes used for obtaining and/or dispensing measured amounts of liquid.

BACKGROUND

Pipettes are often used in a laboratory environment to obtain a desired amount of liquid from one container and to dispense the liquid into a different container. Pipettes are available in many forms, from graduated glass tubes to disposable plastic tubes, but all generally operate in a similar manner. One end of the pipette is placed in the liquid to be aspirated, usually from above the liquid, and a reduced pressure is provided in the pipette to draw the liquid into the pipette. The reduced pressure can be provided in various ways, such as the through the use of a deformable bulb, an electric pump, a syringe-like plunger, etc. Handheld pipettes are commercially available for use in obtaining and dispensing measured amounts of liquid on a milliliter and microliter scale. Handheld pipettes are operable with one hand, and manual versions typically include a spring-loaded plunger for drawing liquid into a disposable pipette tip. With such pipettes, the user depresses the plunger against the bias of the spring, places an end of the tip in the liquid, and releases the plunger to draw the liquid into the tip. The user then depresses the plunger again to dispense the liquid.

The resolution and volume capacity of micropipettes often determine the minimum volume of fluid mixtures that must be prepared in a given situation. For instance, to create a 1:10 mixture of fluids A and B, the minimum measurable volume of fluid A is typically 0.10 μl using a commercially available micropipette. There is also an inherent error when drawing fluids with a micropipette due to the fluid surface energy, pipette tip geometry, room temperature, humidity, and other factors. The relative error (i.e., the ratio of the volume of liquid actually drawn into the pipette to the volume of liquid desired to be drawn into the pipette) is typically greater for smaller liquid volumes. Thus, in order to minimize the error in a fluid mixture requiring a small fraction of one component, larger volumes are sometimes prepared. This practice can lead to significant waste when relatively small volumes of a mixture are needed for an experiment, which is compounded when expensive reagents are used.

SUMMARY

In accordance with one embodiment, a pipette device includes a fluid chamber having an enclosed volume of working fluid and a piston that partially defines the fluid chamber. The piston is movable to displace the working fluid within the fluid chamber. The device also includes a diaphragm that partially defines the fluid chamber. The diaphragm has a chamber side in contact with the working fluid and an opposite side that displaces a measurement volume of fluid outside the fluid chamber when the piston moves to displace a volumetric amount of working fluid. The measurement volume is less than the volumetric amount of working fluid displaced by the piston.

In accordance with another embodiment, a pipette component includes an elastic diaphragm supported by a housing. The diaphragm has a first side that defines a portion of a fluid chamber when the component is assembled as part of a pipette assembly. The pipette component is adapted to deamplify fluid displacement within the fluid chamber at an opposite second side of the diaphragm at least partly via elastic deformation of the diaphragm.

In accordance with another embodiment, a method of calibrating a pipette device includes the steps of: (a) attaching a calibration device including a pressure sensor to the pipette device to enclose a known volume of calibration fluid between the devices; (b) moving a piston of the pipette device to displace a desired volumetric amount of calibration fluid; (c) measuring the pressure change of the enclosed volume of calibration fluid resulting from step (b); and (d) adjusting the pipette device based on the measurement in step (c).

BRIEF DESCRIPTION OF THE DRAWINGS

Exemplary embodiments will hereinafter be described in conjunction with the appended drawings, wherein like designations denote like elements, and wherein.

DETAILED DESCRIPTION

As will become apparent from the following disclosure, a pipette component including a diaphragm may be configured as part of a high-resolution pipette assembly. The pipette component may be in the form of a handheld pipette device, a replaceable pipette tip, or a pipette adapter, to name a few examples. The component functions via a volume deamplification concept in which a pipette piston displaces a volumetric amount of a working fluid on one side of the diaphragm and in which the diaphragm displaces a smaller volumetric amount of fluid at an opposite side of the diaphragm. This displacement reduction from one side of the diaphragm to the other may be characterized by a deamplification ratio that can span multiple orders of magnitude. One or more portions of a fluid chamber that encloses the working fluid may undergo elastic deformation to facilitate the deamplification. Additionally or alternatively, the working fluid may be compressible to contribute to the deamplification. The deamplification ratio and resolution may also be adjustable.

As used herein, a pipette assembly includes one or more individual pipette components arranged together to form an operable pipette, ready for use without further modification. A pipette component is any individual piece or assembled group of pieces that form or are intended to form at least part of the pipette assembly. A pipette device is a pipette component that includes the piston or other displacement mechanism that moves to displace fluid in the pipette assembly during operation. Thus, a pipette assembly is one type of pipette device, and a pipette device is one type of pipette component.

Figure 1:
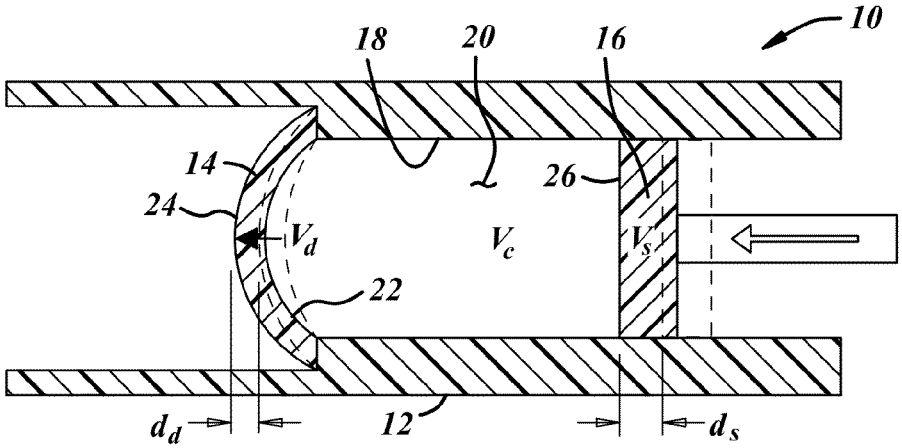
FIG. 1 is a schematic cross-sectional view of a portion of a pipette device, according to one embodiment.

Referring to FIG. 1 a schematic cross-sectional view of a portion of one embodiment of a pipette device 10 is shown. The pipette device 10 includes a housing 12, a diaphragm 14 supported by the housing, and a piston 16 that together at least partly define a fluid chamber 18. The fluid chamber 18 encloses a working fluid 20, which is in contact with the piston 16 and a chamber side 22 of the diaphragm, and the piston 16 is movable to displace the working fluid 20 within the chamber 18. In the illustrated embodiment, the portion of the housing 12 shown is generally tubular with the diaphragm 14 and piston 16 spaced apart inside the housing 12 at opposite ends of the fluid chamber 18, though it is not always the case that the diaphragm 14 and piston 16 are at opposite ends of the chamber 18. The diaphragm 14 is attached to the housing 12 and forms a fluid-tight seal with the housing. The piston 16 forms a moveable fluid-tight seal with the housing 12. This moveable seal moves with the piston 16 as it slides along the interior surface of the housing 12. The piston 16 may be moved manually or automatically to displace or perform work on the working fluid 20. For example, the device 10 may be a handheld pipette device including a user-depressible button. The button may be physically attached to the piston via a rod or other mechanism to translate button movement to piston movement, or the button may energize an electric motor to move the piston.

In operation, the piston 16 moves to displace a volumetric amount of working fluid 20 within the fluid chamber 18. The volumetric amount of displaced working fluid is equal to the volume of the space within the housing that lies between first and second positions of a surface 26 of the piston 16 in contact with the working fluid 20. In the example of FIG. 1, the piston 16 is shown in a second position after being moved from a first position (shown in dashed lines). The volume of fluid, $V_s$, displaced by the piston 16 is equal to the distance, $d_s$, between the first and second positions multiplied by the cross-sectional area of the inside of the housing. The same volumetric amount of fluid, $V_s$, is displaced by the piston when it moves in the opposite direction by the same distance. Fluid displacement by the piston 16 results in a corresponding fluid displacement at the diaphragm 14, which can be determined in a similar manner by calculating the volume, $V_d$, that lies between first and second positions of an opposite side 24 of the diaphragm, which deflects a distance, $d_d$. Though shown in FIG. 1 as a curved diaphragm 14 that has its shape changed when the piston 16 moves, the diaphragm 14 may be any shape and may deflect in any manner that displaces fluid at the opposite side 24 of the diaphragm in response to piston movement.

The volume of fluid displaced at the opposite side 24 of the diaphragm 14 is less than the volume of fluid displaced by the piston 16 ($V_d<V_s$). This result may be referred to as volume deamplification and can be expressed as a deamplification ratio, $V_d/V_s$, which is less than 1. $V_d$ may be also be referred to as a measurement volume, because it corresponds to the amount of liquid that will be drawn into a pipette tip or tips (not shown) attached to the device when the piston 16 is moved back to the first position during use. In the absence of the diaphragm 14, as is the case with conventional handheld pipettes, $V_d$ is generally equal to $V_s$. In other words, the volume of liquid drawn into a conventional pipette as the piston returns to a home or first position is the same as the volume of fluid displaced by the piston when previously moved away from the home position. The pipette components disclosed herein can be used to deamplify the volume displaced by the pipette piston by one or more orders of magnitude, resulting in a high resolution pipette device or assembly that can accurately obtain and/or dispense liquids on a nanoliter or picoliter scale. Such a pipette device can enable the preparation of liquid mixtures in the exact volume required, thereby reducing or eliminating reagent waste.

The deamplification effect is achieved through elastic deformation of one or more portions of the fluid chamber 18 and/or compression of the working fluid 20. In one embodiment, the diaphragm 14 is an elastic diaphragm that undergoes elastic deformation when the piston 16 moves against the working fluid 20 to displace it. In other words, a portion of the work energy transferred to the working fluid 20 by the piston is temporarily stored in the diaphragm 14, which acts as a sort of spring, rather than being directly transferred to fluid displacement at the opposite side 24 of the diaphragm 14.

The working fluid 20 may be a compressible fluid such as air or some other gas. The compressible working fluid 20 compresses when the piston 16 moves against the working fluid 20 to displace it, resulting in an increased fluid chamber pressure. Here, the working fluid acts to temporarily store a portion of the work energy transferred thereto by the piston. In one embodiment, the diaphragm 14 undergoes elastic deformation and the working fluid is compressed when the piston 16 moves against the working fluid 20 to displace it. Thus, diaphragm elasticity and working fluid compressibility may be used in various combinations to arrive at the desired deamplification ratio. Other portions of the fluid chamber 18 may be configured to elastically deform instead of or in addition to the diaphragm 14, such as one or more additional diaphragms arranged to define a portion of the fluid chamber. In one embodiment, at least a portion of the housing 12 is made from a sufficiently compliant material so that it undergoes elastic deformation when the piston 16 moves against the working fluid 20.

The pipette device 10 may also be constructed so that the volume deamplification, and thereby the resolution, of the device is adjustable. For example, in embodiments where the working fluid 20 is compressible, the effective compressibility of the working fluid 20 can be made adjustable or selectable. In another example, an effective stiffness of the portion(s) of the fluid chamber 18 that undergo elastic deformation can be made adjustable and/or selectable.

Figure 2:
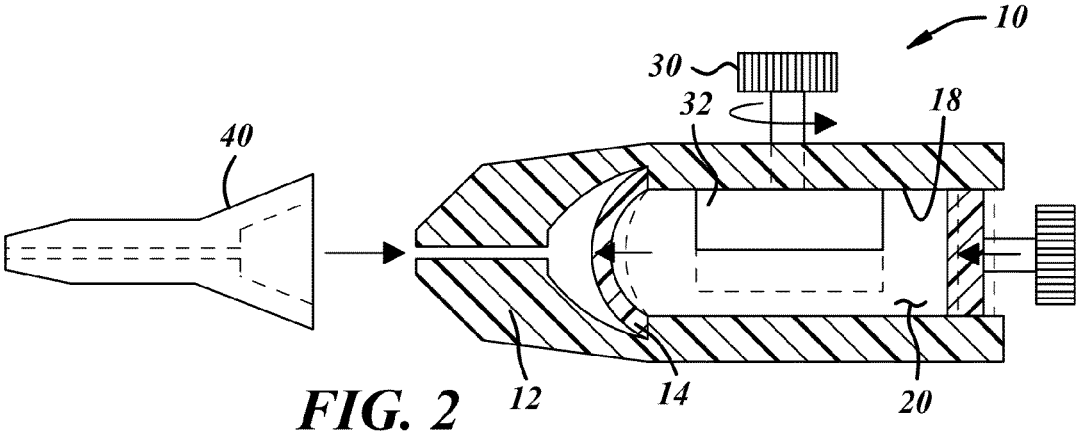
FIG. 2 is a schematic cross-sectional view of one embodiment of a pipette device with a resolution adjustment mechanism and a removable pipette tip.

Referring to FIG. 2, the pipette device 10 may include a resolution adjustment mechanism 30. FIG. 2 also illustrates a pipette tip 40 configured for removable attachment to the pipette device 10 to form a working pipette assembly. The illustrated adjustment mechanism 30 functions by adjusting the effective compressibility or stiffness of the fluid chamber volume. The mechanism 30 includes a chamber portion 32 that extends and retracts into the housing 12 between the diaphragm 14 and the piston 16 to change the shape and/or volume of the fluid chamber 18 when the user turns a knob on the outside of the housing, for example. Though not shown in FIG. 2, the device 10 may also include a valve that can open to equalize fluid chamber pressure with the atmosphere if desired and/or a port or valve that accommodates attachment of a pressure source for increasing or otherwise altering the pressure inside the fluid chamber 18. The illustrated adjustment mechanism 30 may operate to change the resolution and volumetric capacity of the device in multiple ways. For example, the mechanism 30 may add or remove a calibrated volume ($\Delta V$) of compressible working fluid 20 to or from the chamber 18. This can change the compressibility of the chamber volume, and applies to many types of fluids, including those with a linear bulk modulus. The resolution adjustment mechanism 30 may also volumetrically displace the compressible working fluid by $\Delta V$, thereby changing the chamber pressure. Certain fluids, such as those described by the ideal gas law (e.g., air) exhibit a scaling of compressibility with pressure. In this regard, changing the pressure exerted on the working fluid 20 alters the deamplification ratio and changes the resolution of the pipette device 10. In another embodiment, the resolution adjustment mechanism 30 may directly or indirectly stretch or relax the diaphragm 14, thereby altering the fluid chamber pressure and changing the deamplification ratio. Of course, other resolution adjustment mechanisms that function by altering the volume and/or pressure of the fluid chamber will be apparent to skilled artisans.

Figure 3:
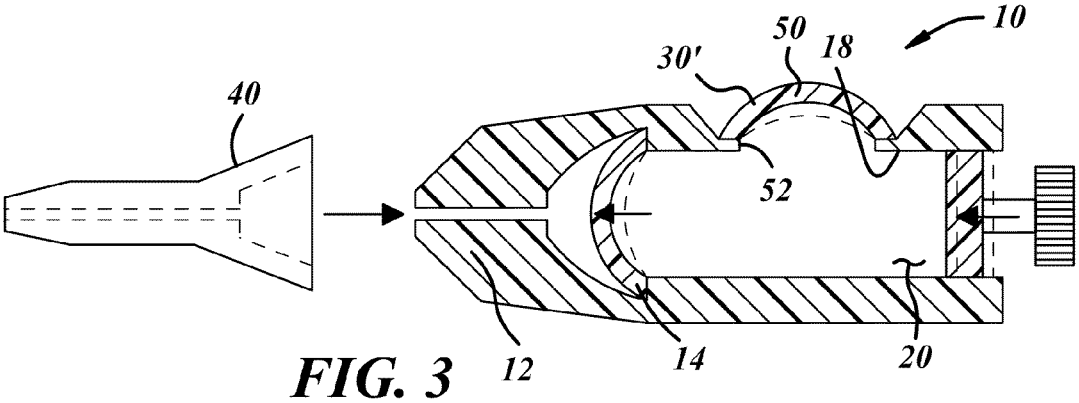
FIG. 3 is a schematic cross-sectional view of a different embodiment of a pipette device with a resolution adjustment mechanism and a removable pipette tip.

FIG. 3 illustrates the pipette device 10 equipped with another example of the resolution adjustment mechanism 30'. Adjustment mechanism 30' functions by adjusting the effective stiffness of a portion of the fluid chamber 18. In the particular embodiment of FIG. 3, the adjustment mechanism 30' is in the form of a secondary diaphragm 50 that defines a portion of the fluid chamber 18 at one side, with an opposite side exposed to atmospheric pressure. Here, the diaphragm 14 that displaces fluid along the pipette tip 40 when in operation may be referred to as the primary diaphragm, and movement of the piston 16 elastically deforms both of the diaphragms 14 and 50. The volumetric displacement at each of the diaphragms 14, 50 is affected by the relative effective stiffness of each. Thus, volume deamplification at the primary diaphragm 14 may be adjusted by changing the stiffness of the secondary diaphragm 50. For example, the diaphragm 50 may be interchangeable so that it can be replaced by a diaphragm that is thicker and/or made from a higher modulus material to increase the amount of volume displacement at the primary diaphragm 14, or by a diaphragm that is thinner and/or made from a lower modulus material to decrease the amount of volume displacement at the primary diaphragm 14.

The effective stiffness of the secondary diaphragm 50 may also be changed by adjusting the size of an aperture 52 to affect the amount of diaphragm 50 surface area the fluid chamber pressure acts upon. For example, an iris-like mechanism may be employed to reduce or increase the size of the aperture 52 to respectively increase or decrease the effective stiffness of the diaphragm 50. The aperture 52 may be located on the opposite side of the secondary diaphragm 50. Embodiments of the adjustment mechanism 30' that function by altering the stiffness of any of the diaphragms may employ other means to affect diaphragm stiffness, such as controlled diaphragm temperature changes or controlled diaphragm stretching, for example. Embodiments of the adjustment mechanism employing a secondary diaphragm may be used with both compressible and incompressible working fluids. Use of an incompressible working fluid 20 may be advantageous in applications where it is desired to help prevent vibration of one or both of the diaphragms 14, 50 during piston movement.

In one embodiment, the resolution adjustment mechanism 30' includes a plurality of secondary diaphragms 50. These secondary diaphragms may be selectively exposed to the working fluid 20 as part of the fluid chamber 18 in different configurations to affect the displacement range of the primary diaphragm 14 in a manner analogous to a parallel circuit. Alternatively, a plurality of secondary diaphragms may be arranged one over another to affect the overall effective diaphragm stiffness in a manner analogous to a series circuit. Thus, the resolution adjustment mechanism 30' can be configured such that the pipette device 10 includes a configurable circuit of secondary diaphragms having a combined effective stiffness that enables broad adjustment of the capacity and resolution of the device.

A pipette device equipped with a resolution adjustment mechanism such as that described herein can potentially replace an entire set of commercially available pipettes, which are typically sold in sets with each pipette in the set having a particular resolution over a particular volume range. The resolution adjustment mechanism may also be useful for calibration purposes—i.e., the pipette device can be fine-tuned to compensate for typical sources of error. For example, conventional pipettes are typically calibrated using a reference liquid such as water at particular environmental conditions with a standardized pipette tip. But in practice, they are used with a variety of liquids with various characteristics (e.g., surface tension, viscosity, etc.) and at a variety of environmental conditions (e.g., temperature, humidity, etc.). The accuracy of a pipette device with adjustable resolution as described herein can be fine-tuned for use in particular situations, such as with a certain fluid or in a certain environment. For instance, it may be desirable to fit a non-standard pipette tip, such as a tip designed to transfer 100 nl of liquid or less, to the device. Such a pipette tip may have a relatively small inner diameter, causing it to have a higher resistance to liquid flow and/or causing measurement error due to capillary action in the tip. The resolution adjustment mechanism can be used to compensate for measurement error caused by these and other variables.

The pipette device 10 may be adapted for attachment of a single pipette tip 40, as shown in the embodiments of FIGS. 2 and 3, or it may be adapted for attachment of a plurality of pipette tips. For example, housing 12 may include a plurality of fluid channels in fluid communication with the opposite side (i.e., the tip side) 24 of the diaphragm 14 with each individual fluid channel adapted for fluid communication with a different pipette tip so that the measurement volume of fluid, $V_d$, is divided among the plurality of pipette tips in operation. In another embodiment, the device 10 includes a plurality of diaphragms 14 and is adapted for attachment of a corresponding plurality of pipette tips. In this example, the working fluid 20 of fluid chamber 18 is in contact with the chamber side 22 of each of the plurality of diaphragms 14 and deflects each of them, while the opposite side 24 of each diaphragm displaces fluid along a corresponding one of the pipette tips 40. These and other multi-tip embodiments may or may not include a resolution adjustment mechanism.

Figure 4:
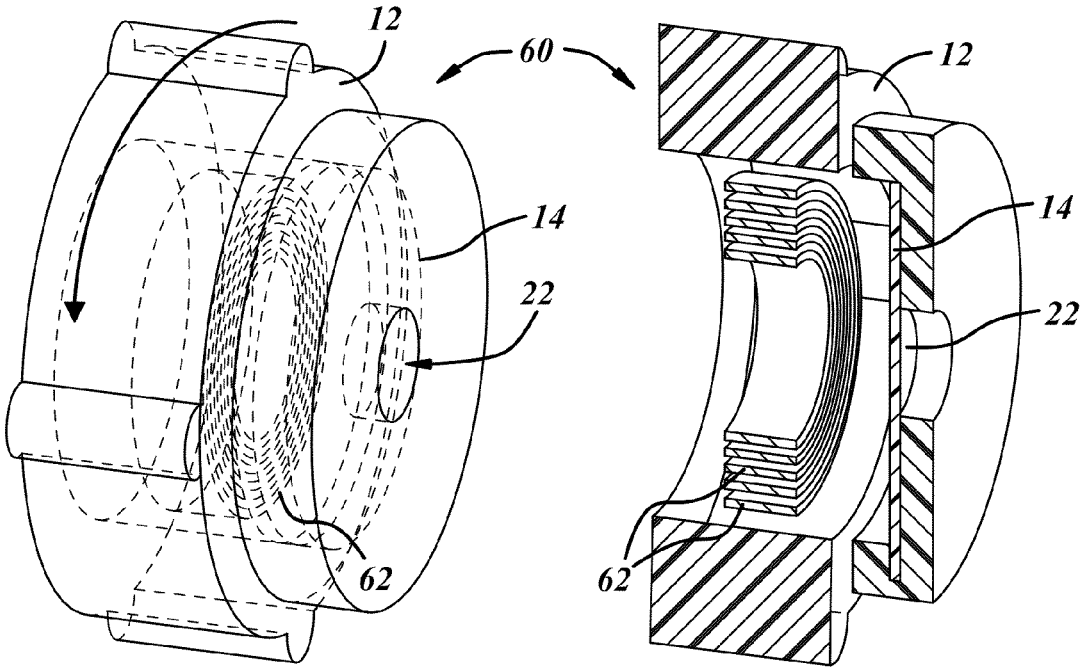
FIG. 4 is a perspective view (left) and a cross-sectional view (right) of a portion of a pipette device including a resolution adjustment mechanism with a plurality of sizing rings.
Figure 5:
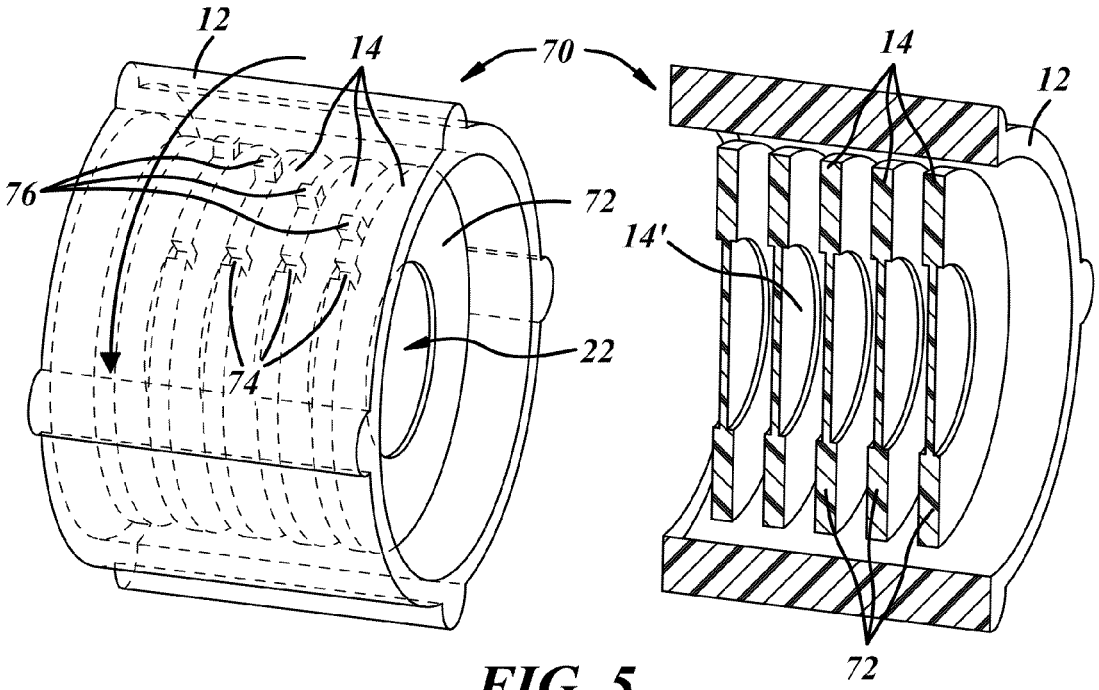
FIG. 5 is a perspective view (left) and a cross-sectional view (right) of a portion of a pipette device including a resolution adjustment mechanism with a plurality of diaphragms.

FIGS. 4 and 5 illustrate additional embodiments of the resolution adjustment mechanism 60, 70. Each of these examples operates by altering the effective stiffness of the diaphragm(s) 14 situated between the pipette tip and the enclosed working volume of the pipette assembly. The particular mechanism 60 of FIG. 4 includes a plurality of diaphragm sizing rings 62 selectable to set the effective diameter of the diaphragm 14, and thereby set the effective stiffness of the diaphragm 14. Each individual sizing ring 62 has a different inside diameter, and the rings 62 are nested within one another in this example. The mechanism 60 may be configured so that a portion of the housing that surrounds the set of sizing rings 62 can be rotated by the user to axially move and press the desired sizing ring against the diaphragm 14 at the side of the diaphragm opposite the fluid chamber side 22, though other mechanisms such as levers or buttons may be configured to move the sizing rings. For example, rotation of the housing portion may cause the largest sizing ring 62 to be pressed against the diaphragm 14, and further rotation may cause subsequently smaller sizing rings 62 to be pressed against the diaphragm until the desired effective diaphragm stiffness is achieved. A similar mechanism may be employed with the secondary diaphragm as well, where included.

Referring to FIG. 5, the illustrated example of the resolution adjustment mechanism 70 includes a diaphragm cartridge or assembly 14' with a plurality of diaphragms 14, each with its own stiffness. For example, each of the individual diaphragms 14 may have a different effective diameter, a different thickness, and/or be made from a different material than other diaphragms in the mechanism 70. In the particular embodiment of FIG. 5, the mechanism 70 allows selection of an individual diaphragm 14 by sealing the selected diaphragm 14 with the surrounding housing 12 and leaving the remaining diaphragms unsealed with the housing. For example, each diaphragm 14 may include a frame or support 72 with a notch 74 formed in the frame where the frame meets the housing 12, as shown. The mechanism 70 may also include corresponding sealing elements 76 arranged to seal a particular diaphragm 14 with the housing 12 by closing off the corresponding notch 74. A similar arrangement may be used for selection of secondary diaphragms in communication with the fluid chamber. In another embodiment, the mechanism 70 is configured to seal more than one of the plurality of diaphragms with the housing 12 to place two or more diaphragms 14 together in series. In another embodiment, the mechanism 70 may be configured to place two or more diaphragms 14 together in parallel so that each is in communication with the fluid chamber of the pipette assembly on one side and with the pipette tip on the opposite side. Each of the plurality of diaphragms placed together in series, in parallel, or in any combination thereof, may have the same effective stiffness or a different effective stiffness than any other of the plurality of diaphragms.

In one implementation, the resolution adjustment mechanism includes a plurality of diaphragms and has the individual diaphragms arranged in a manner that provides a configurable diaphragm circuit so that the total number of possible deamplification ratios is greater than the number of diaphragms—i.e., the same diaphragms can be arranged differently. In a relatively simple example, the resolution adjustment mechanism may include two diaphragms having the same effective stiffness. Each diaphragm alone may provide a deamplification ratio of 0.1, for example, when placed between the chamber volume and the pipette tip. These two diaphragms arranged in series would provide a deamplification ratio of 0.01. The same two diaphragms placed in parallel (with only one of them in communication with the pipette tip, as in FIG. 3) would provide a deamplification ratio between 0.1 and 0.2. Additional diaphragms and/or diaphragms with different effective stiffnesses can provide finer adjustment of the deamplification ratio due to the greater number of diaphragm circuit configurations. Thus a pipette device may be designed to have various selectable resolutions corresponding to predetermined diaphragm circuit configurations so that a user can select from 1 ml, 1 μl, or 1 nm capacities, for example, or from 1 μl, 2 μl, 4 μl, etc. capacities in another example.

Figure 6:
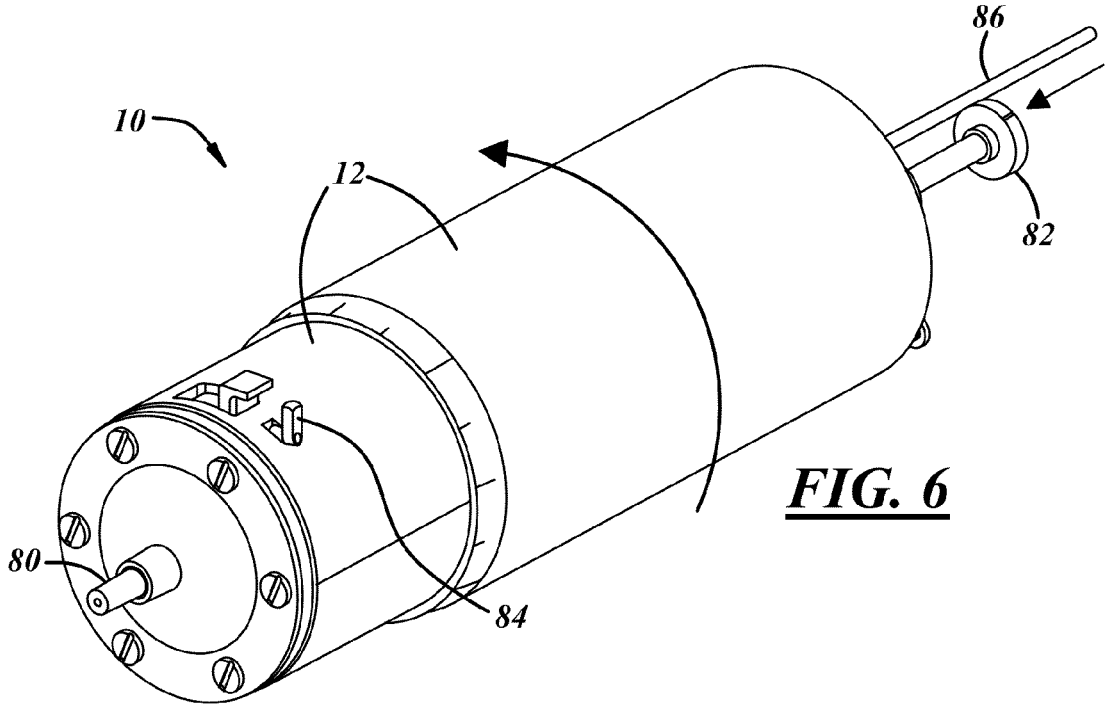
FIG. 6 is a perspective view of a pipette device including a resolution adjustment mechanism according to another embodiment.
Figure 7:
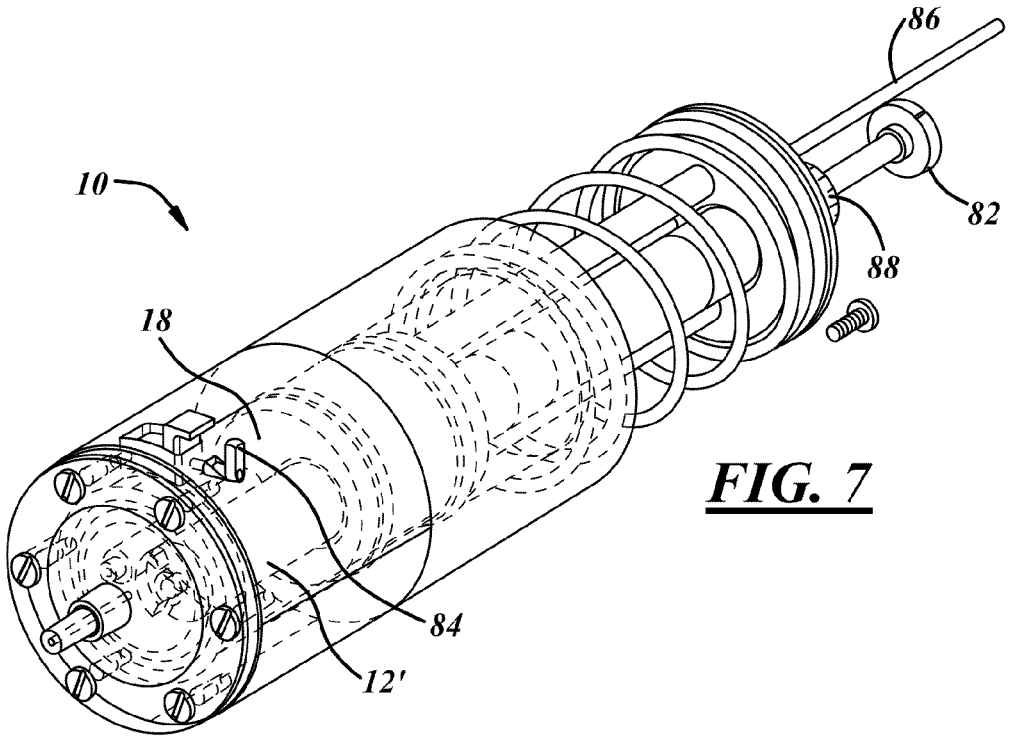
FIG. 7 is a view of the pipette device of FIG. 6, with a portion of the housing removed.
Figure 8:
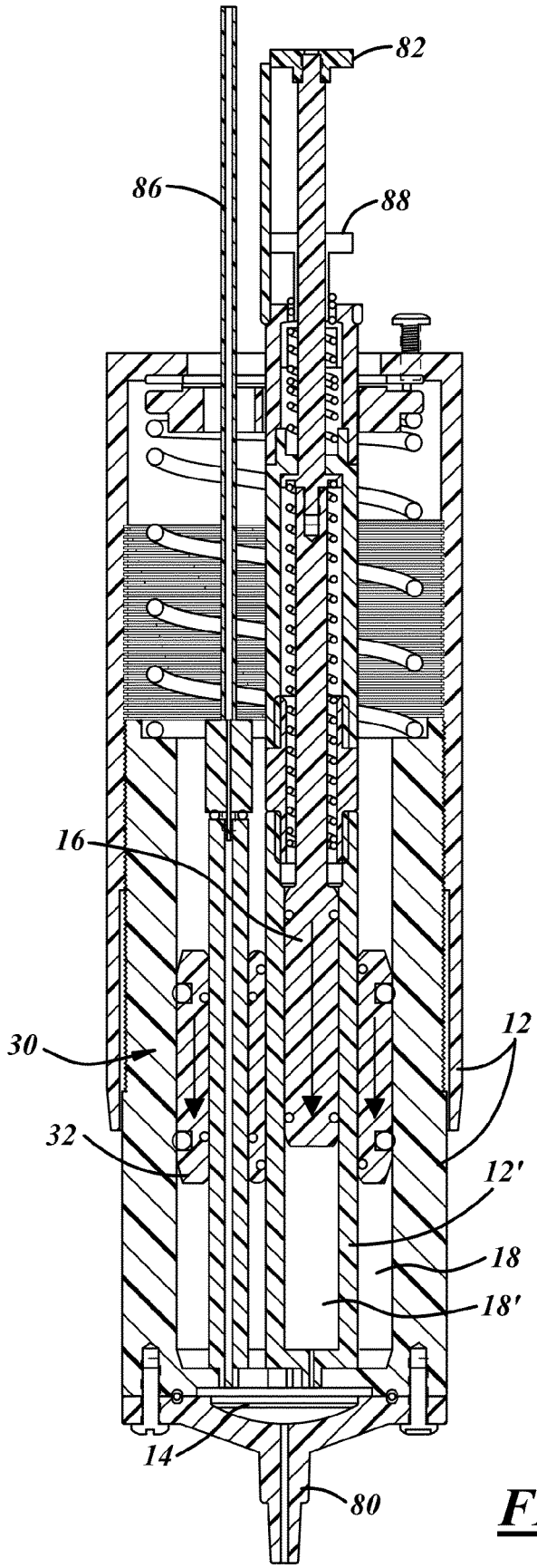
FIG. 8 is a cross-sectional view of the pipette device of FIG. 6.

FIGS. 6-8 illustrate one embodiment of the pipette device 10 equipped with a resolution adjustment mechanism 30 that operates similar to that shown in FIG. 2—i.e. by providing for adjustment of the volume of the fluid chamber 18. FIG. 6 is a perspective view of the exterior of the device 10. The external housing 12 is formed in two (front and rear) portions with one nested in the other so that each portion can rotate with respect to the other about a common longitudinal axis. FIG. 6 also shows an end cap 80 at one (front) end of the device, an actuator 82 at the opposite (rear) end of the device, a valve 84 located along the front portion of the housing 12, and a line 86 for attachment of a pressure transducer or external pressure or vacuum source. In this example, the actuator 82 is a manually operated thumb push-button. FIG. 7 shows the device 10 of FIG. 6 with the rear portion of the housing removed and with some of the internal components shown in dashed lines. An actuator stop 88 and an internal housing portion 12' are also shown in FIG. 7. The internal housing portion 12' houses the piston and includes part of the fluid chamber 18 therein. The valve 84 is in communication with the fluid chamber 18 and is operable to equalize fluid chamber pressure with the atmosphere when desired.

With reference to the cross-section of FIG. 8, the end cap 80 is adapted for attachment of a disposable pipette tip and may be removable to service and/or replace the diaphragm 14 with a different diaphragm having a different effective stiffness, for example. The actuator 82 may be spring-loaded and moveable by a user to actuate or move the piston 16 within the housing as shown. Other types of actuators such as electrically powered actuators may be used as well. Line 86 is in fluid communication with the fluid chamber 18 and may be connected to a pressure transducer or other device to measure, monitor, and/or control the fluid chamber pressure. Line 86 or an additional line may be included for attachment to an external pressure or vacuum source to control chamber pressure. The actuator stop 88 acts as a positive stop for the actuator 82 and sets the volume displacement of the piston 16. The stop 88 may be spring-loaded as shown and turned or rotated to adjust its axial position.

In this embodiment, the fluid chamber 18 includes a cylindrical portion 18' inside the internal housing portion 12' that is in fluid communication with a tubular or annular portion that surrounds the internal housing portion 12'. The piston 16 moves within the internal housing portion 12' to displace working fluid. The resolution adjustment mechanism 30 is operable to change the volume of the fluid chamber 18. In particular, the chamber portion 32 of the adjustment mechanism has its location fixed with one of the external housing portions 12, which are threaded where they are connected so that relative rotation of the housing portions changes the overall length of the device 10. This changes the position of portion 32 of the adjustment mechanism 30 within the housing 12, thereby changing the volume of the tubular portion of the fluid chamber 18 and the volume of the fluid chamber as a whole. This is of course but a single example of a pipette device with adjustable resolution, and skilled artisans may devise other methods and structures intended to adjust the volume and/or pressure of the fluid chamber. Moreover, each of the above examples of the resolution adjustment mechanism and/or its principles of operation may be combined in any number of ways to provide resolution adjustment for the pipette device.

Figure 9:
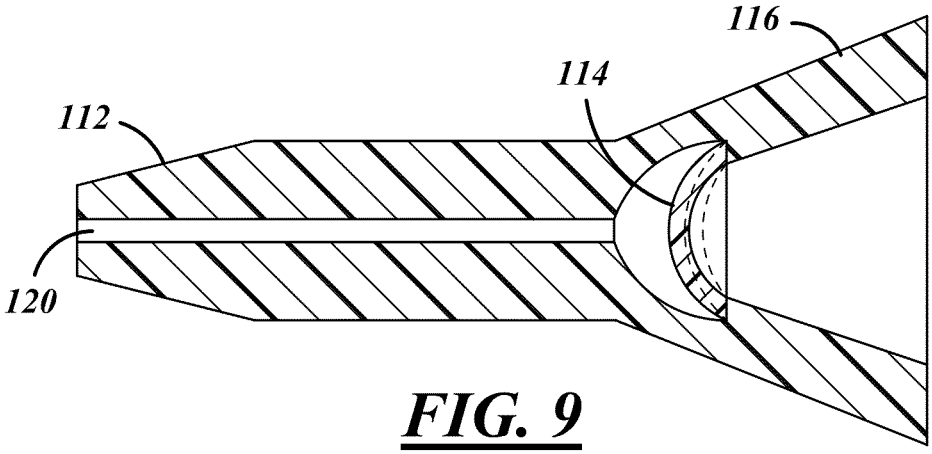
FIG. 9 is a cross-sectional view of one embodiment of a pipette tip, including a diaphragm.

Referring now to FIG. 9, a different type of pipette component 100 for use as part of a pipette assembly with volume deamplification is shown. The illustrated component is a pipette tip 100 and includes a tip housing 112 that supports an elastic diaphragm 114. The diaphragm 114 is located between opposite first and second ends 116, 118 of the housing 112. The first end 116 is adapted for removable attachment to a pipette device, and the second end 118 has an opening to receive and dispense the liquid to be measured. When assembled as part of a pipette assembly (e.g., when attached to an appropriate pipette device), the pipette tip 100 partially defines a fluid chamber filled with air as the working fluid. For example, the pipette tip of FIG. 9 can be constructed so that the housing 112 is the same general shape as commercially available disposable pipette tips to fit conventional pipette devices with 1:1 piston displacement to measurement volume ratios to form pipette assemblies with volume deamplification. In this case, the pipette tip 100 and the pipette device together define the fluid chamber between the diaphragm 114 and the piston or plunger of the pipette device. Passage 120 may have an internal diameter smaller than commercially available pipette tips and a corresponding smaller opening at the second end 118 to be better suited for the smaller volume of measured liquid enabled by volume deamplification.

The principles of volume deamplification described above are the same whether the diaphragm is located in a pipette tip housing 112 as shown in FIG. 9 or in a device housing 12 as shown in some of the previous figures. Including the diaphragm as part of a disposable pipette tip 100 may offer a simple and effective technique to achieve pipette volume deamplification without modification of existing pipette devices. The effective stiffness of the elastic diaphragm 112 of this embodiment determines the deamplification ratio of the resulting pipette assembly. Pipette tips may thus be provided with a variety of diaphragm stiffnesses corresponding to calibrated deamplification ratios or scale factors. For instance, pipette tips may be manufactured with nominal scale factors of 1/2, 1/10, 1/100, etc. to alter the native volumetric capacity and resolution of an existing pipette device. Analytical models described in further detail below indicate that this scale factor may span several orders of magnitude.

Figure 10:
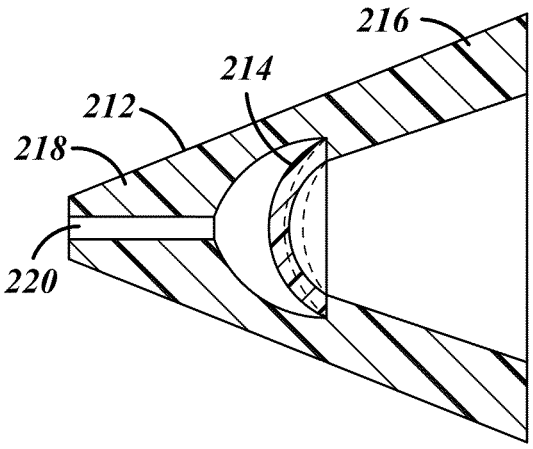
FIG. 10 is a cross-sectional view of one embodiment of a pipette adapter, including a diaphragm.

FIG. 10 illustrates another embodiment of a pipette component 200 for use as part of a pipette assembly with volume deamplification. The illustrated component is a pipette adapter 200 and includes an adapter housing 212 that supports an elastic diaphragm 214. As is apparent, the adapter 200 is configured similar to the pipette tip of FIG. 9 and operates in substantially the same manner, with the first end 216 of the housing adapted for removable attachment to a pipette device, and the second end 218 of the housing adapted to receive a pipette tip. The pipette adapter 200 can also be provided with a diaphragm 214 having a stiffness corresponding to a calibrated deamplification ratio to retrofit an existing pipette device and impart it with volume deamplification while maintaining the ability to use standard disposable pipette tips with the device.

Figure 11:
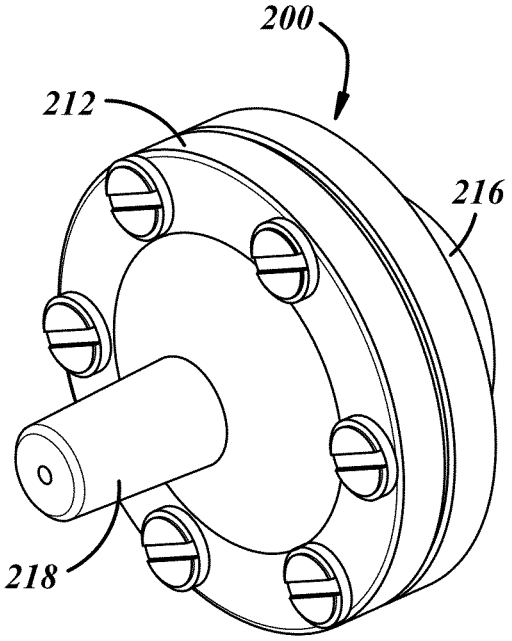
FIG. 11 is a perspective view of another embodiment of a pipette adapter.
Figure 12:
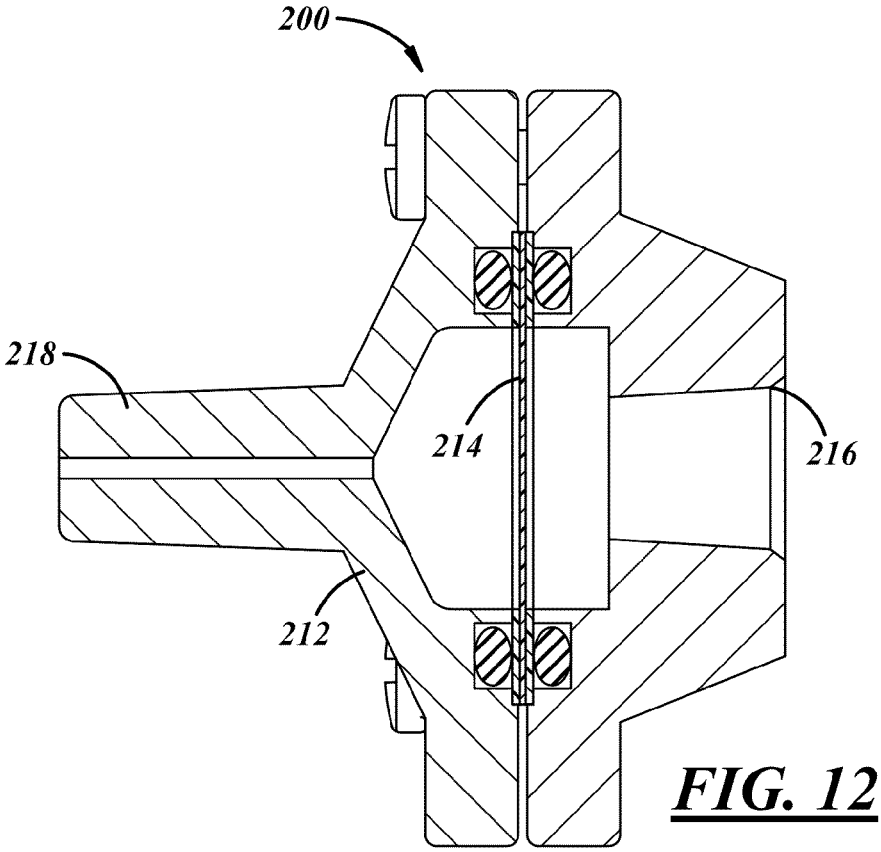
FIG. 12 is a cross-sectional view of the pipette adapter of FIG. 11.
Figure 13:
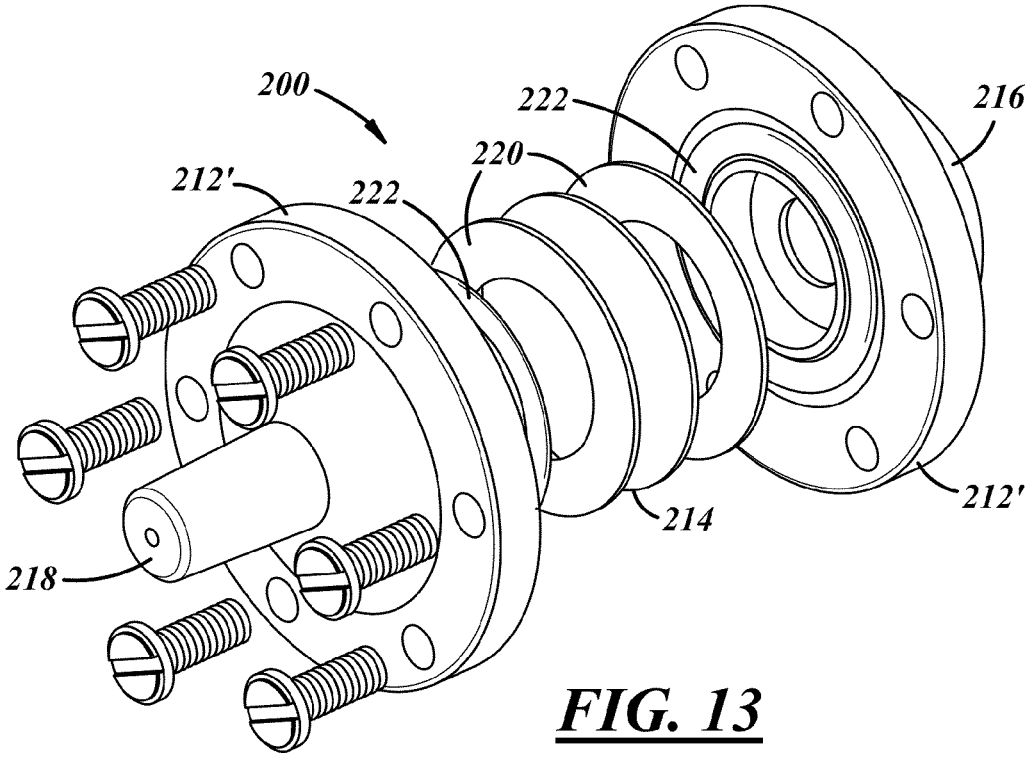
FIG. 13 is an exploded view of the pipette adapter of FIG. 11.

FIGS. 11-13 illustrate one particular embodiment of the pipette adapter 200. FIG. 11 is a perspective view showing the adapter 200, including housing 212 with first and second ends 216, 218 adapted for respective attachment between a pipette device and a pipette tip to form a pipette assembly. FIG. 12 shows the adapter 200 in cross-section, with the elastic diaphragm 214 sandwiched between separable portions of the housing 212. In one embodiment, the diaphragm 214 is a flat piece of elastomeric material, such as latex rubber, though other polymeric or non-polymeric materials may be used in some cases. This flat configuration may be useful for ease of manufacturing of the diaphragm from a flat sheet or roll of material, and may also be used in other embodiments of volume deamplifying pipette components such as pipette devices or pipette tips. FIG. 13 is an exploded view of the pipette adapter 200 of FIGS. 11 and 12, showing the housing separated into two portions 212'. This particular embodiment includes plates or rings 220 arranged at opposite sides of the diaphragm 214 that provide annular clamping surfaces to support the diaphragm in the housing when assembled. The center opening of the plates 220 may be sized to help achieve the desired deamplification ratio for the adapter 200. The housing portions 212' may be attached together using fasteners as shown or any other suitable means. The illustrated embodiment also includes seals 222 in the form of O-rings to form a fluid-tight seal between each housing portion 212' and each corresponding plate 220.

Figure 14:
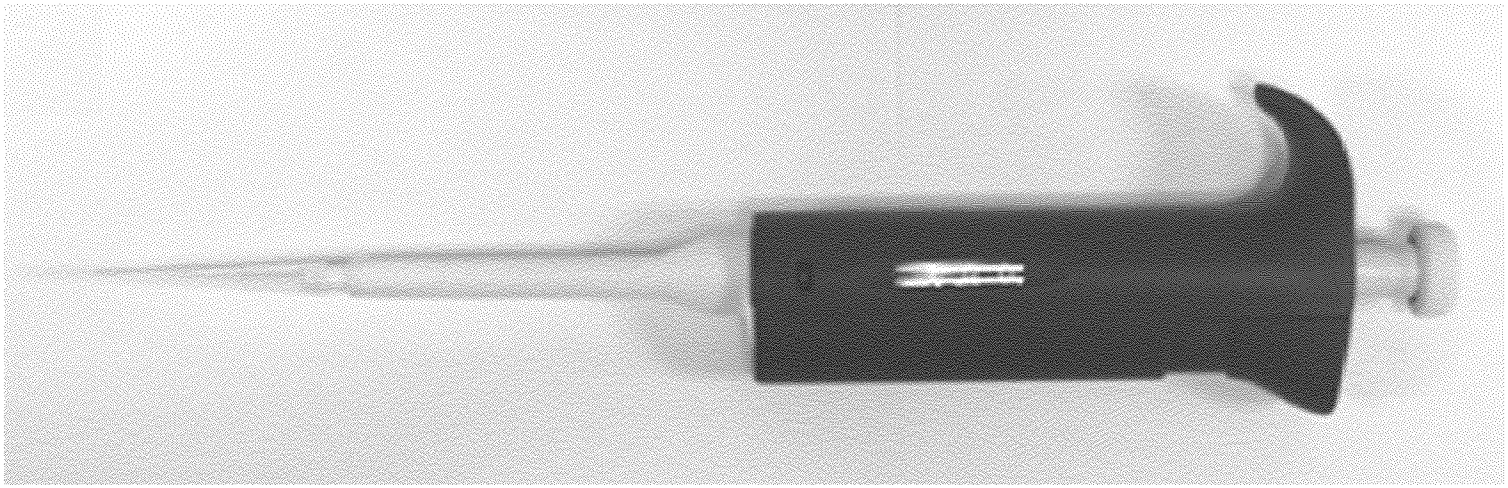
FIG. 14 is a photographic image of a commercially available pipette assembly, including a handheld pipette device and a disposable pipette tip.
Figure 15:
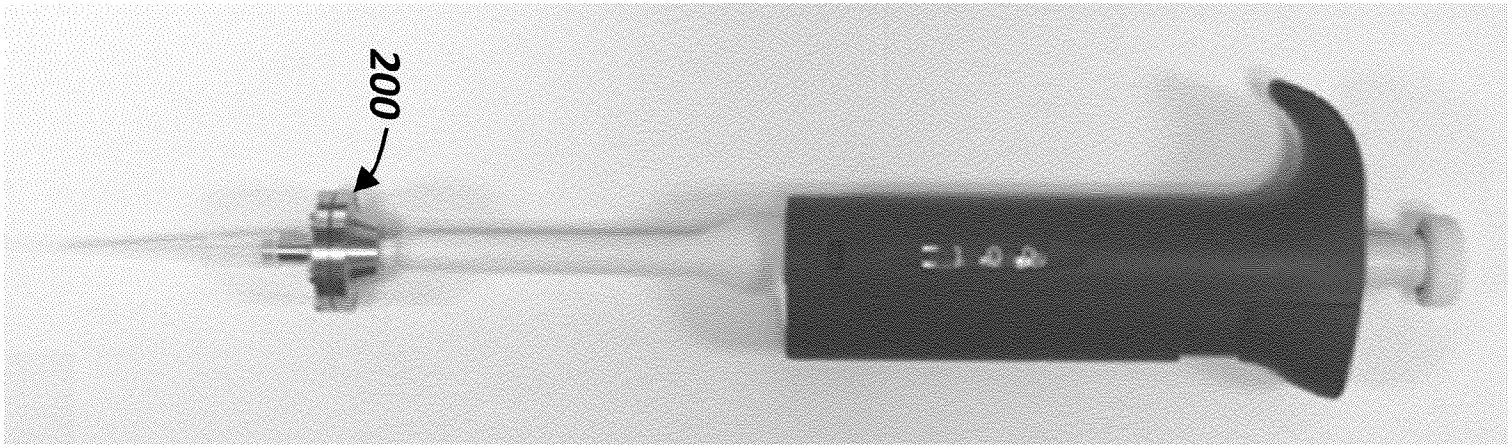
FIG. 15 is a photographic image of the pipette assembly of FIG. 14 with a working example of the pipette adapter of FIG. 11 included between the pipette device and the pipette tip.

FIGS. 14 and 15 demonstrate how the described pipette adapter 200 can be retrofitted to a commercially available pipette device or assembly. In particular, FIG. 14 is a photograph of a commercially available, handheld pipette device fitted with a standard, disposable pipette tip to form a working pipette assembly. FIG. 15 shows the same handheld pipette device with a working example of the pipette adapter 200 depicted in FIGS. 11-13 fitted between the pipette device and the disposable pipette tip.

EXAMPLE

Experiments have been conducted using the pipette assembly shown in FIG. 15, including a pipette component in the form of the illustrated pipette adapter 200. The adapter was attached to the commercially available 20-200 μl micropipette device (Finnpipette 2, available from TFS, Waltham, Mass.) shown in FIG. 15. When fitted with a diaphragm as described above, the adapter forms a fluid chamber filled with air as the working fluid between the diaphragm and an internal portion of the pipette device. Actuation of the pipette plunger acts against the working fluid, thereby deforming the diaphragm. The diaphragm in this example was constructed from a flat sheet of latex material, and different latex sheet thicknesses were used to obtain different diaphragm stiffnesses to adjust the volume deamplification ratio of the pipette assembly.

Figure 16:
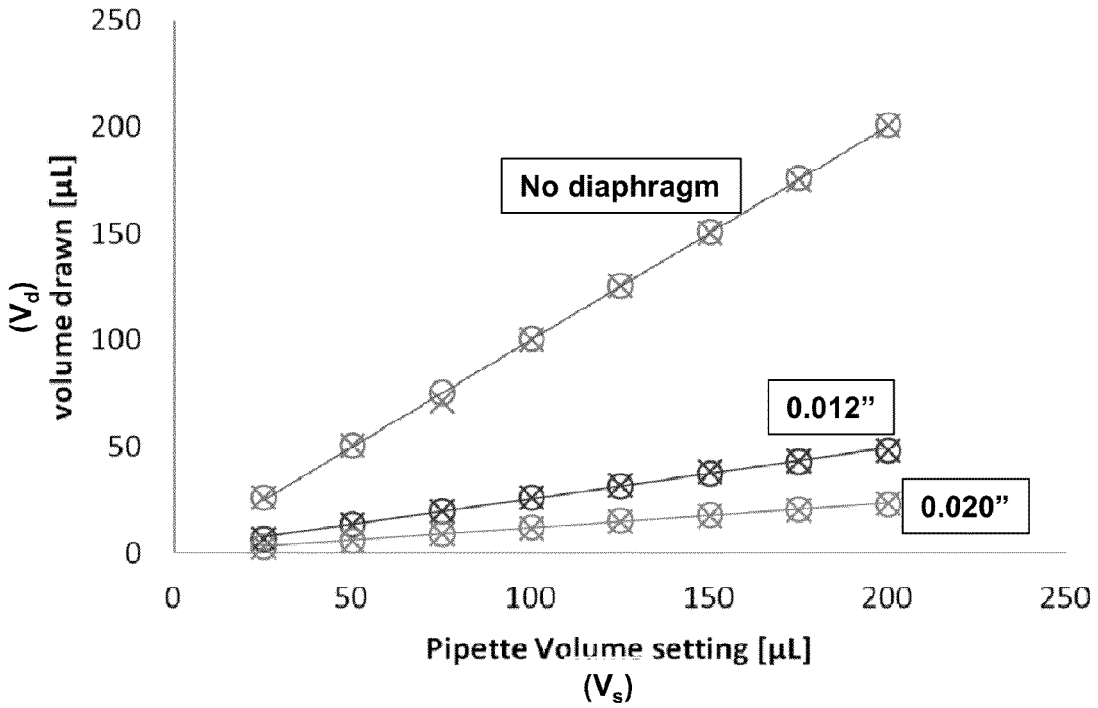
FIG. 16 is a chart showing the volume of fluid drawn into the pipette assembly of FIG. 15 with various levels of volume deamplification.

FIG. 16 is a chart plotting the results of measurements recorded for the pipette assembly of FIG. 15, including the pipette adapter fitted with a 0.012 inch thick latex diaphragm, a 0.020 inch thick diaphragm, and no diaphragm. The effective diameter of the diaphragm in this case was about 0.5 inches. Water was used as the measured liquid across the range of the native volume settings (20-200) μl) of the micropipette device. A microbalance scale was used to measure the weight of the water drawn into the pipette assembly for each volume setting ($V_s$), which corresponds to volume displaced by the pipette piston. Each weight measurement was converted to a measurement volume or drawn volume ($V_d$) for the chart of FIG. 16. Two series of measurements, shown as O's and X's in the chart, were conducted for each case, indicating that the results are repeatable. FIG. 16 shows that volume deamplification is linear across the entire native range of the pipette device, and that the deamplification ratio can be tuned by choosing the membrane stiffness. According to linear curve fits, the deamplification ratios, represented by the slope of each curve, are 0.24 for the 0.012" diaphragm, 0.12 for the 0.20" diaphragm, and 1.0 with no diaphragm (as expected). For instance, the adapted commercial pipette device draws a volume ($V_d$) of 24 μl of liquid when set at a volume ($V_s$) of 100 μl with the 0.012" diaphragm in the adapter ($V_d/V_s$=0.24).

Governing Equations

The volume deamplification principles described above, and the design of a pipette component in accordance with the present teachings, may be guided by a mathematical model which is herein derived. Several physical relationships among parameters of the system shown in FIG. 1 may be defined. First, the total volume, $V_c$, of the enclosed fluid chamber is:

$$V_C=V_{C_o}-V_s+V_d, \tag{1}$$

where $V_{Co}$ is an initial fluid chamber volume, $V_s$ is the volume of fluid displaced by the piston, and $V_d$ is the volume displaced by the diaphragm. In embodiments where the working fluid is air, the compressibility of the working fluid is well-approximated by the ideal gas law:

$$P_C V_C=nRT \tag{2}$$

where $P_c$ is fluid chamber pressure, n is the molar amount of entrapped air, R is the universal gas constant, and T is absolute temperature. The boundaries of the fluid chamber (other than the diaphragm) are assumed to be rigid in this case.

Next, diaphragm stiffness, k (expressed in N/m$^5$, for example), is defined as the parameter relating change in pressure across the diaphragm, $\partial P_C$-$\partial P_o$ (expressed in Pa, for example), to displaced volume at the diaphragm, $\partial V_d$, which is not necessarily linear, and generally considered a function of diaphragm deformation, $V_d$, or equivalently, the pressure difference across the diaphragm, $P_C$-$P_o$:

$$\frac{\partial P_C-\partial P_o}{\partial V_d}=k=f(V_d). \tag{3}$$

Equation (1) may be expressed in differential form:

$$\frac{\partial V_s}{\partial P_d}=1-\frac{\partial V_C}{\partial V_d}=1-\frac{\partial V_C}{\partial P_C}\frac{\partial P_C}{\partial V_d}, \tag{4}$$

where the partial derivative of the ideal gas law (Eq. 2) with respect to $P_C$ provides a definition for $\partial V_C/\partial P_C$, and $\partial P_C/\partial V_d$ is defined by rearrangement of Eq. 3. These substitutions are made into Eq. 4 to arrive, after some algebraic manipulation, at a differential equation (Eq. 5) relating fluid displacement by the piston to fluid displacement at the diaphragm:

$$-nRT\int_{V_{Co}}^{V_{air}}\frac{1}{V_{air}^2}\partial V_{air}=\int_0^{V_d}k\partial V_d+\int_{P_{o,i}}^{P_{o,f}}\partial P_o, \tag{5}$$

The bounds of integration are chosen to represent a change from an 'initial' state to an 'actuated state' (Eq. 5). The 'initial' state defines $V_s$=$V_d$=0, so that the molar amount of entrapped air, n, occupies some initial chamber volume, $V_{Co}$. Formally, this nominal condition places no restriction on the state of diaphragm deformation, the absolute piston position, or the pressures $P_{o,i}$ and $P_C$. Practically speaking, it is convenient to define this nominal state by $P_{o,i}$=$P_C$=$P_{atm}$, where $P_{atm}$ represents atmospheric pressure. Here, the entire device, including the inside of the chamber, is simply exposed to the ambient environment, making $V_{Co}$ and n easily calculable based on the chamber geometry.

$$nRT\left(\frac{1}{(V_{Co}-V_s+V_d)}-\frac{1}{V_{Co}}\right)=\int_0^{V_d}k\partial V_d+P_oD \tag{6}$$

$$D\triangleq\frac{P_{o,f}-P_{o,i}}{P_o}.$$

The 'actuated' state refers to the condition where a piston stroke, $V_s$, and/or external pressure, $P_{o,f}$, act on the system (i.e., $V_s\neq0$ and/or $P_{o,f}\neq0$). Notably, the $P_o$ integral is independent of any system parameters and therefore simply represents the change in an external pressure applied to the diaphragm (i.e., $P_{o,f}$-$P_{o,i}$). This external pressure difference and the piston stroke constitute two independent inputs that act on the pipette system, resulting in some deflection of the diaphragm, $V_d$, and some change in the working fluid, $V_C$.

In practical terms, Eq. 6 corresponds to the relationship between piston stroke and diaphragm displacement for a handheld pipette with volume deamplification that includes a fluid chamber of compressible gas as the working fluid. D is a dimensionless disturbance term representing the change in external pressure applied to the diaphragm divided by some nominal pressure quantity $P_o$ such that |D|<1 across the range of system operation. This external pressure disturbance is, namely, the capillary pressure of the measured liquid in the pipette tip. Note that Eq. 6 is accurate for any arbitrary combination and magnitude of $V_s$ and D.

Figure 17:
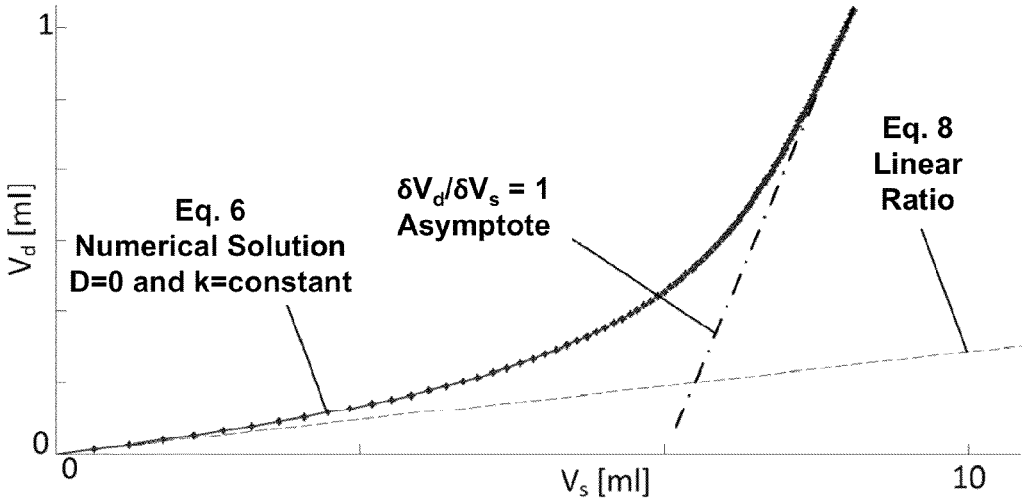
FIG. 17 is a chart showing solutions for mathematical models of the volume deamplification of the pipette device.

To understand the characteristics of the pipette, a representative curve of diaphragm displacement, $V_d$, as a function of piston displacement, $V_s$, for the case D=0 and k=constant, is plotted numerically in FIG. 17. As shown in the figure, there are two asymptotic limits: one for small displacements and one for large displacements. For small displacements, the initial slope of the curve is determined by the following parameters of the system: diaphragm stiffness (k), chamber volume ($V_{Co}$), and atmospheric pressure ($P_{atm}$). This initial slope is depicted by the dashed line in FIG. 17.

For sufficiently large displacements, the curve approaches a slope of 1 (i.e., $\partial V_d/\partial V_s=1$) regardless of the system parameters. This is because fluid chamber pressure builds during piston movement due to diaphragm stiffness. As fluid chamber pressure increases, the compressibility of the working fluid decreases according to the ideal gas law (Eq. 2). The system approaches a displacement ratio of 1 as the working fluid becomes incompressible.

For reasons of simplicity and practicality, it may be desirable that the pipette device is characterized by a deamplification ratio that is tunable and constant across the full range of the device for a given deamplification setting. This implies that the pipette must operate near $V_s=0$. The numerical computation of Eq. 6, again for k=constant, enables insights regarding different methods of affecting the deamplification ratio, and are considered separately below.

Figure 18:
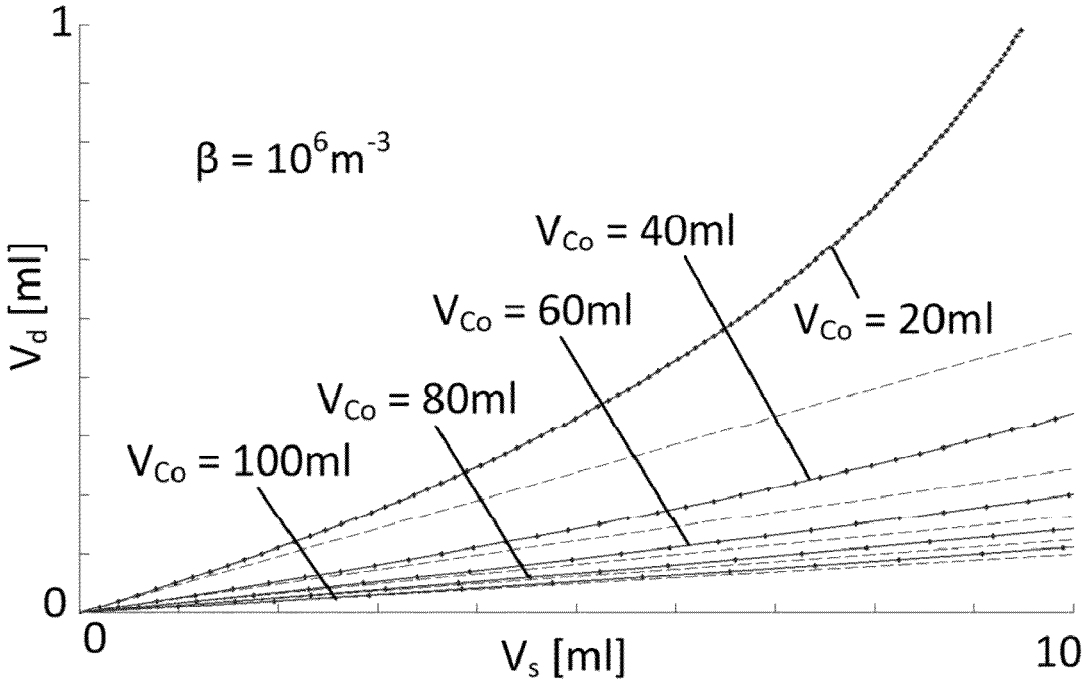
FIG. 18 is a chart showing volume deamplification with various fluid chamber volumes and constant diaphragm stiffness.

In one example, a user may desire to pipette liquids ranging from 1 nl to 1 ml, and the maximum practical chamber size for a handheld pipette is considered to be about 100 ml. FIG. 18 shows that the desired range can be achieved by varying chamber size only while holding the diaphragm stiffness constant. But non-linearities arise with higher volume deamplification (smaller fluid chamber volume), so that the deamplification is non-constant across the pipette volume range. This is because fluid displacement by the piston becomes too large compared to the fluid chamber volume for the system to remain approximately linear.

Figure 19:
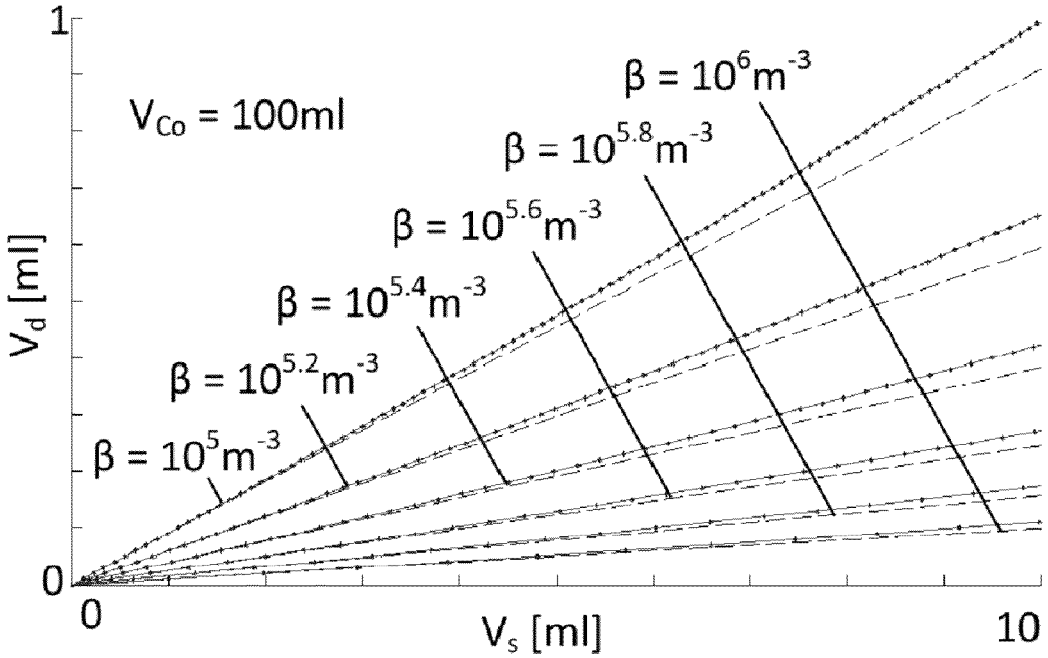
FIG. 19 is a chart showing volume deamplification with various diaphragm stiffness values and constant fluid chamber volume.

FIG. 19 shows that altering the diaphragm stiffness, while holding the volume of the fluid chamber constant and as large as conveniently possible, causes the respective deamplification ratio associated with each effective diaphragm stiffness to remain approximately constant across the full volumetric range of the pipette for a given range of diaphragm stiffnesses. Thus, providing a pipette component in which the diaphragm stiffness can be changed to change the deamplification ratio enables a pipette device or assembly with a volume displacement range and resolution that is adjustable over a very wide range. Of course, non-linear deamplification systems may be employed as well, and user-selectable piston actuator settings could be calibrated to account for such non-linearities.

Another notable observation is that nonlinear diaphragm stiffness (e.g. membrane stiffening effects) may be utilized to cancel the nonlinearity from compression of the working fluid. By Taylor-Series expansion, with respect to $V_s$ and D about $V_s=D=0$, the model (Eq. 6) may be reduced to a simplified parametric equation (Eq. 7) that captures key characteristics of the pipette:

$$V_d = (C_{1,0}V_s + C_{2,0}V_s^2) + (C_{0,1}D + C_{0,2}D^2) + (C_{1,1})DV_s, \tag{7}$$

$$C_{1,0} = \frac{1}{\left(\frac{V_{Co}^2}{nRT}k_0 + 1\right)} = \frac{1}{\left(\frac{V_{Co}}{P_{atm}}k_0 + 1\right)} \tag{8}$$

$$C_{2,0} = \frac{V_{Co}^3\left(k_0^2 - \frac{nRT}{2V_{Co}}k_1\right)}{(nRT)^2\left(\frac{V_{Co}^2}{nRT}k_0 + 1\right)^3} = \frac{V_{Co}\left(k_0^2 - \frac{P_{atm}}{2}k_1\right)}{P_{atm}^2\left(\frac{V_{Co}}{P_{atm}}k_0 + 1\right)^3} \tag{9}$$

-continued $$C_{0,1} = \frac{-V_{Co}^2 P_o}{(nRT)^2\left(\frac{V_{Co}^2}{nRT}k_0 + 1\right)} = \frac{V_{Co}}{\left(\frac{V_{Co}}{P_{atm}}k_0 + 1\right)} \tag{10}$$

$$C_{0,2} = \frac{V_{Co}^3 P_o^2}{(nRT)^2\left(\frac{V_{Co}^2}{nRT}k_0 + 1\right)^3} = \frac{V_{Co}}{\left(\frac{V_{Co}}{P_{atm}}k_0 + 1\right)^3} \tag{11}$$

$$C_{1,1} = \frac{2V_{Co}^3 P_o k_0}{(nRT)^2\left(\frac{V_{Co}^2}{nRT}k_0 + 1\right)^3} = \frac{2V_{Co}k_0}{P_{atm}\left(\frac{V_{Co}}{P_{atm}}k_0 + 1\right)^3}. \tag{12}$$

This parametric expression captures the first two terms in the Taylor-series expansion of the diaphragm stiffness function, k:

$$k(V_d) \cong k_0 + k_1 V_d. \tag{13}$$

The $C_{i,i}$ coefficient equations (7-12) are expressed in general form (left side) and also for the convenient physical case where $P_c=P_o=P_{atm}$ (right side). The diaphragm displacement, $V_d$, is described by the $C_{i,0}$ and $C_{0,i}$ coefficients for the respective cases of an independent piston stroke, $V_s$, and independent pressure disturbance, D. If both $V_s$ and D occur simultaneously, the coupling coefficient, $C_{1,1}$, contributes to $V_d$ as well. The linear volume deamplification ratio is described by the $C_{1,0}$ coefficient and all other coefficients represent the most significant non-linear contributions to the diaphragm displacement, $V_d$. Equations 7-13 may also capture the particular case of linear diaphragm stiffness discussed previously by letting $k_1=0$, thereby $k=k_0$=constant.

If pressure disturbances are negligible (i.e., D<<1), then the performance of the pipette is well-described by only the coefficients $C_{1,0}$ and $C_{2,0}$. Notably, the dimensions and material properties of the diaphragm may be designed such that $k_0^2=(P_{atm}/2)k_1$, thereby setting the quadratic coefficient, $C_{2,0}=0$. Under these conditions, the volume deamplification of the pipette is exactly linear over the pipetting range, and is described by the $C_{1,0}$ coefficient. Of course, the $V_d/V_s$ curve may be superlinear, with an increasing slope as $V_s$ increases, or sub-linear, with a decreasing slope as $V_s$ increases. The shape of the curve is predictable and can be controlled according to Eq. 7, above.

Pipette Device: Working Example

Figure 20:
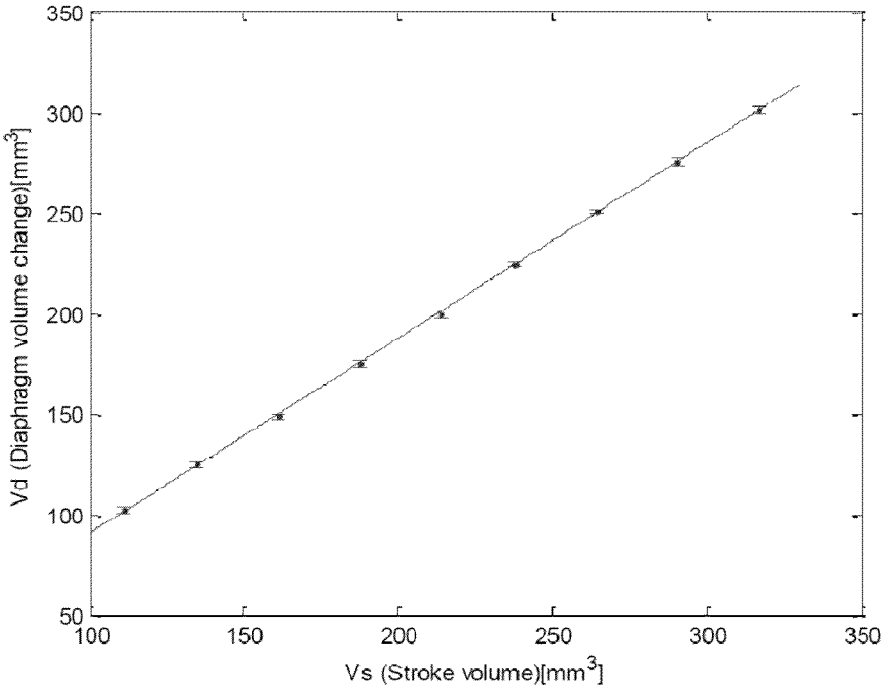
FIG. 20 is a chart showing the volume range of fluid drawn by a pipette device constructed according to FIGS. 6-8 with the diaphragm omitted.
Figure 21:
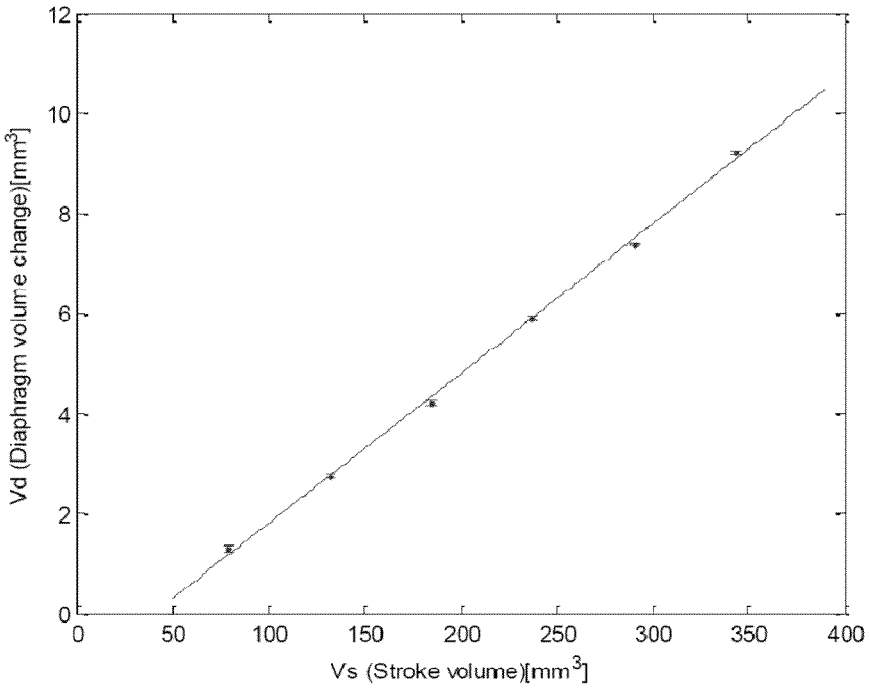
FIG. 21 is a chart showing the volume range of fluid drawn by the pipette device constructed according to FIGS. 6-8 with a diaphragm installed.

A working example of the pipette device according to FIGS. 6-8 has been constructed and used to verify the governing equations. The illustrated device included for an adjustable chamber volume $V_{Co}$, an adjustable (interchangeable) diaphragm stiffness k, and a known and adjustable piston displacement and associated $V_s$. FIG. 20 shows the limiting case for the maximum pipetting volume range of the experimental device with no diaphragm installed, which is 100-300 μl. The limiting case for minimum volume range was 1-10 μl and was achieved using a latex sheet with a thickness of 0.030 inches and an effective diameter of 0.25 inches as the diaphragm. Thus, the constructed device had an overall range from 1-300 μl. The lower volume limit was limited by the imprecision of the experimental pipetting environment rather than the characteristics of the experimental pipette device.

Figure 22:
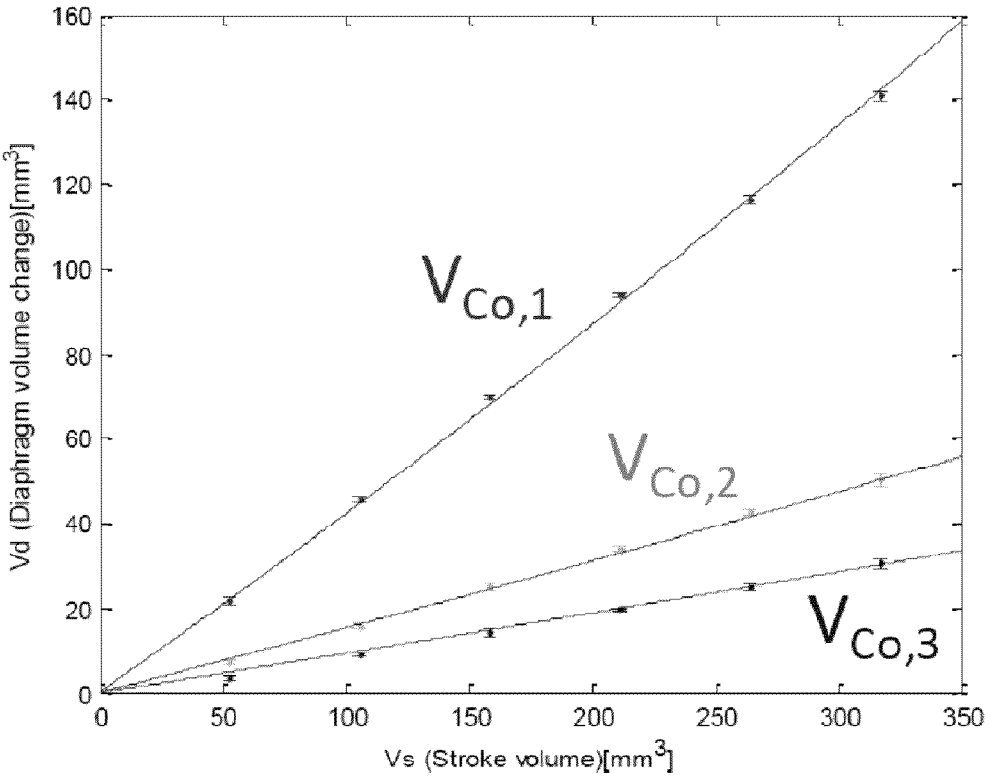
FIG. 22 is a chart showing the volume range of fluid drawn by the pipette device constructed according to FIGS. 6-8 with a diaphragm installed and with the fluid chamber adjusted to various volumes.

To validate the governing equation, a 0.014 inch thick latex diaphragm with an effective diameter of 0.5 inches was fitted to the device. Water was pipetted onto a microbalance to determine $V_d$. In FIG. 22, $V_d$ is plotted as a function of $V_s$ for three different fluid chamber volumes: $V_{Co,1}$=0.964 ml; $V_{Co,2}$=2.65 ml; and $V_{Co,3}$=4.34 ml. The curves in FIG. 22 are fitted to the experimental data using a single value for the diaphragm stiffness, k. Since a single value for k fits all three data sets, it may be concluded that the theoretical model is accurate. In this case, $k=1.25\times10^8$ N/m$^5$ for each curve.

Pipette Calibration Device

Figure 23:
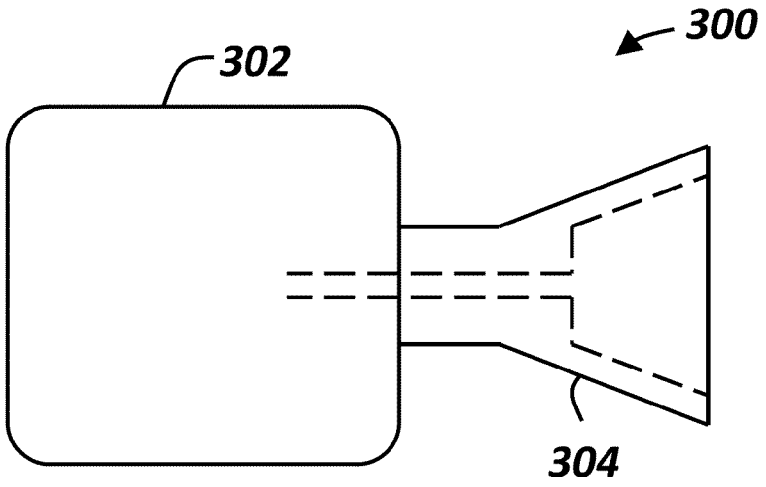
FIG. 23 is a schematic side view of an illustrative pipette calibration device.

The accuracy of any pipette device, including the device described herein, may be checked using a calibration device 300 as shown in FIG. 23. The illustrated device 300 includes a pressure sensor 302 and a pipette interface 304. Pipette interface 304 can be shaped similar to a pipette tip to allow a user to removably attach the calibration device to the pipette device in the same manner as a pipette tip. Attaching the calibration device 300 to the pipette device encloses a known volume of calibration fluid (e.g., air) between the pipette device and the calibration device 300. More specifically, the calibration fluid is enclosed within a chamber defined by inner surfaces of the pipette device, including the piston and/or one or more diaphragms, and by inner surfaces of the calibration device, including the pressure sensor 302 and the pipette interface 304. Actuation and movement of the piston of the pipette device in a direction that compresses the working fluid increases the pressure of the calibration fluid. This pressure change is measured by the pressure sensor 302.

Where air is the calibration fluid, the pressure change is described by the ideal gas law. For pipette devices with no deamplification (i.e., a deamplification ratio of 1), this pressure change is directly related to the volume displaced by the pipette device piston. This can be compared to the expected pressure change for a known piston stroke and indicates the accuracy of the pipette device. For a pipette device with deamplification, the measured pressure change may indicate the fidelity of one or more of the following, depending on the particular embodiment: primary diaphragm stiffness, secondary diaphragm stiffness(es), deamplification ratio, or plunger volume displacement. Adjustments to the pipette device (e.g., adjustment of the chamber volume or replacement of one or more diaphragms) may be made in response to these results. If the pipette device piston is electrically actuated, the calibration device 300 may communicate directly with the pipette device to execute a calibration routine and/or adjust one or more settings of the pipette device.

It is to be understood that the foregoing is a description of one or more exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A pipette device, comprising:

a fluid chamber having an enclosed volume of working fluid;

a piston that partially defines the fluid chamber, the piston being movable to displace the working fluid within the fluid chamber; and a diaphragm that partially defines the fluid chamber, the diaphragm having a chamber side in contact with the working fluid and an opposite side that displaces a measurement volume of fluid outside the fluid chamber when the piston moves to displace a volumetric amount of working fluid, wherein the pipette device is adapted to deamplify fluid displacement within the fluid chamber at said opposite side of the diaphragm at least partly via elastic deformation of the diaphragm, whereby the measurement volume is less than the volumetric amount of working fluid displaced by the piston.

2. The pipette device as defined in claim 1, wherein the working fluid is a compressible fluid.

3. The pipette device as defined in claim 1, wherein the working fluid is an incompressible fluid.

4. The pipette device as defined in claim 1, wherein the diaphragm undergoes elastic deformation when the piston moves against the enclosed volume of working fluid.

5. The pipette device as defined in claim 1, further comprising a secondary diaphragm that defines a portion of the fluid chamber and that undergoes elastic deformation when the piston moves against the enclosed volume of working fluid.

6. The pipette device as defined in claim 1, further comprising a housing that defines a portion of the fluid chamber, wherein at least a portion of the housing undergoes elastic deformation when the piston moves against the enclosed volume of working fluid.

7. The pipette device as defined in claim 1, wherein the working fluid remains enclosed within the fluid chamber at the chamber side of the diaphragm during piston movement.

8. The pipette device as defined in claim 1, wherein the piston is moveable in a first direction by a distance, to compress the working fluid and move the diaphragm a first amount, and wherein the piston is moveable in a second direction opposite from the first direction by the same distance, $d_s$, to decompress the working fluid and move the diaphragm a second amount that is equal to the first amount, diaphragm movement being in one direction during working fluid compression and in another opposite direction during working fluid decompression.

9. The pipette device as defined in claim 1, further comprising a manual actuator that moves the piston.

10. The pipette device as defined in claim 1, further comprising an electrically operated actuator that moves the piston.

11. The pipette device as defined in claim 1, wherein the measurement volume is selectable in a range that spans two or more orders of magnitude.

12. The pipette device as defined in claim 1, wherein the measurement volume is selectable in a range that includes measurement volumes of less than about 0.5 microliters.

13. The pipette device as defined in claim 1, wherein the measurement volume is selectable in a range from about 1 nanoliter to about 1 milliliter.

14. The pipette device as defined in claim 1, wherein the measurement volume is selectable in a range from about 10 nanoliters to about 10 microliters.

15. The pipette device as defined in claim 1, wherein the device has a range of selectable values for said volumetric amount of working fluid, and wherein the device is configured with a linear deamplification ratio over said range, the deamplification ratio being defined as the ratio of the measurement volume to the volumetric amount of working fluid displaced by the piston.

16. The pipette device as defined in claim 1, wherein the device has a range of selectable values for said volumetric amount of working fluid, and wherein the device is configured with a superlinear or sublinear deamplification ratio over said range, the deamplification ratio being defined as the ratio of the measurement volume to the volumetric amount of working fluid displaced by the piston.

17. The pipette device as defined in claim 1, wherein a deamplification ratio is defined by the measurement volume divided by the volumetric amount of working fluid displaced by the piston, and said ratio is 0.25 or less.

18. The pipette device as defined in claim 17, wherein said ratio is 0.01 or less.

19. The pipette device as defined in claim 1, wherein the device is adapted for simultaneous attachment of a plurality of pipette tips such that the measurement volume is divided among the plurality of pipette tips.

20. The pipette device as defined in claim 19, comprising a plurality of diaphragms, wherein each of the plurality of diaphragms has a chamber side in contact with the working fluid and an opposite side configured to displace fluid along a corresponding one of the plurality of pipette tips.

21. The pipette device as defined in claim 1, further comprising a valve operable to selectively allow fluid flow between the fluid chamber and a location outside of the fluid chamber.

22. The pipette device as defined in claim 21, wherein the location outside of the fluid chamber is at atmospheric pressure.

23. The pipette device as defined in claim 21, wherein the location outside of the fluid chamber is an adjustable pressure source.

24. The pipette device as defined in claim 1, further comprising a resolution adjustment mechanism.

25. The pipette device as defined in claim 24, wherein the resolution adjustment mechanism includes a portion that partly defines the fluid chamber, said portion being movable to change the volume of the fluid chamber independently from th§e piston.

26. The pipette device as defined in claim 24, wherein the resolution adjustment mechanism includes a plurality of interchangeable diaphragms.

27. The pipette device as defined in claim 24, wherein the resolution adjustment mechanism includes a mechanism that changes the amount of surface area of the diaphragm, and/or of a secondary diaphragm, that the working fluid acts upon, thereby changing the effective stiffness of the diaphragm(s).

28. The pipette device as defined in claim 24, wherein the resolution adjustment mechanism includes a mechanism that stretches the diaphragm and/or a secondary diaphragm, thereby changing the effective stiffness of the diaphragm(s).

29. The pipette device as defined in claim 24, wherein the resolution adjustment mechanism includes an interchangeable diaphragm.

30. The pipette device as defined in claim 29, wherein said diaphragm that partially defines the fluid chamber is a primary diaphragm, the pipette device further comprises a secondary diaphragm that partially defines the fluid chamber, and the primary diaphragm is the interchangeable diaphragm.

31. The pipette device as defined in claim 29, wherein said diaphragm that partially defines the fluid chamber is a primary diaphragm and the interchangeable diaphragm is a secondary diaphragm.

32. A pipette component, comprising an elastic diaphragm supported by a housing, the diaphragm having a first side that defines a portion of a fluid chamber when the component is assembled as part of a pipette assembly, wherein the pipette component is adapted to deamplify fluid displacement within the fluid chamber at an opposite second side of the diaphragm at least partly via elastic deformation of the diaphragm.

33. The pipette component as defined in claim 32, wherein the component is a handheld pipette device that includes the fluid chamber and a piston that is movable to displace a working fluid within the fluid chamber, the pipette device being adapted for attachment to a pipette tip to form said pipette assembly.

34. The pipette component as defined in claim 32, wherein the component is a pipette tip adapted for removable attachment to a pipette device having a movable piston to form said pipette assembly.

35. The pipette component as defined in claim 32, further comprising at least a portion of a resolution adjustment mechanism.

36. The pipette component as defined in claim 32, wherein the component is a pipette adapter adapted for attachment between a pipette device and a pipette tip to form said pipette assembly so that portions of the pipette adapter and the pipette device together define the fluid chamber.

37. The pipette component as defined in claim 36, wherein the elastic diaphragm is interchangeable.

38. The pipette device comprising the pipette component of claim 36, the device being adapted for attachment of interchangeable pipette tips.

* * * * *